United States Patent [19]

Schindele

[11] Patent Number: 4,576,018

[45] Date of Patent: Mar. 18, 1986

[54] STITCH-FORMING MACHINE

[75] Inventor: Alfred Schindele, Filderstadt, Fed. Rep. of Germany

[73] Assignee: Terrot Strickmaschinen GmbH, Stuttgart, Fed. Rep. of Germany

[21] Appl. No.: 613,957

[22] Filed: May 25, 1984

[30] Foreign Application Priority Data

Jun. 3, 1983 [DE] Fed. Rep. of Germany ..... 3320043

[51] Int. Cl.[4] ..... D04B 15/06

[52] U.S. Cl. ..... 66/106

[58] Field of Search ..... 66/104, 106, 109

[56] References Cited

U.S. PATENT DOCUMENTS

| | | | |
|---|---|---|---|
| 1,653,886 | 12/1927 | Billings | 66/106 |
| 1,829,094 | 10/1931 | Ingalls | 66/106 |
| 2,329,617 | 9/1943 | Ingalls | 66/106 |
| 2,375,475 | 5/1945 | Holmes et al. | 66/104 X |
| 3,754,416 | 8/1973 | Apprich | 66/106 |

FOREIGN PATENT DOCUMENTS

| | | | |
|---|---|---|---|
| 2430824 | 1/1976 | Fed. Rep. of Germany | 66/106 |
| 2642079 | 3/1978 | Fed. Rep. of Germany | 66/106 |
| 20835AD1894 | of 0000 | United Kingdom | 66/104 |
| 1230680 | 5/1971 | United Kingdom | 66/106 |
| 199316 | 8/1967 | U.S.S.R. | 66/106 |

*Primary Examiner*—Wm. Carter Reynolds

*Attorney, Agent, or Firm*—Shenier & O'Connor

[57] ABSTRACT

The invention relates to stitch-forming machines, which have needles guided on a needle support means for longitudinal displacement and controlled by needle cams and which also have sinkers displaceable between the needles in the region of their heads, these sinkers having sinker throats and knitting surfaces and being controlled by sinker cams. In order to shorten the distance to be travelled by the needles during drawing of the loops it is suggested that the sinkers be mounted in a plane cam guideway by means of a projecting swivel butt for pivoting movement only and not be displaceable in a longitudinal direction and that the distance from the sinker throats and knitting surfaces to the adjacent edge of the needle support means be alterable solely due to pivoting movement of the sinker.

2 Claims, 5 Drawing Figures

STITCH-FORMING MACHINE

The invention relates to a stitch-forming machine comprising needles guided on a needle support means for longitudinal displacement and controlled by needle cams and also comprising sinkers displaceable between said needles in the region of their heads, these sinkers having sinker throats and knitting surfaces and being controlled by sinker cams.

During stitch formation, the sinkers of known knitting machines of this type (German Offenlegungsschrift 31 08 041) are moved lengthwise on the needle support means contrary to drawing movement of the needle so that the distance the needles must travel during drawing is correspondingly shorter. Since the curve of the needle cam guideway formed by the needle cams may then be designed somewhat flatter the knitting speed may be considerably increased. The sinkers of these machines may, furthermore, still be displaced transversely to the associated needles in order to guide the sinkers into the cast-off or knocking-over position and then back to their initial position when the needle is driven out. During transverse displacement of the sinkers, their sinker throats hold down the semifinished course and prevent the knitted fabric from being taken up when the needles are driven out again.

The sinkers of the known machines, which must be displaced both longitudinally and transversely, are relatively long and heavy. They form at the same time lateral guide webs for the needle shafts. This causes a great deal of friction, a high level of noise and makes considerable drive power necessary. For reasons of space and construction, it is difficult for a customary pattern device to be mounted in addition on such known machines and only simple stitch combinations may therefore be produced.

The object of the invention is to improve a knitting machine of the type in question such that the sinkers used are relatively small, light and quiet in operation and enable use of an additional pattern device.

This object is accomplished according to the invention in that the sinkers are mounted in a plane cam guideway by means of a protruding swivel butt for pivoting movement only and are not displaceable in the longitudinal direction and that the distance from the sinker throats and knitting surfaces to the adjacent edge of the needle support means is alterable solely due to this pivoting movement of the sinkers.

In contrast to the known knitting machines, with which the holding-down and knocking-over sinkers in question are mounted on the needle support means for longitudinal and transverse displacement, the sinkers of the invention are mounted on the sinker cam. Consequently, the sinkers may be geometrically arranged and designed such that the movement of the sinker knitting surface contrary to movement of the needle during drawing may be brought about solely by pivoting movement of the sinker. It is no longer necessary for the sinker to be displaced in a longitudinal direction. The sinker may then be short and of a light weight and does not cause friction by rubbing on the needle. In particular, the sinker may be so short that it is mounted solely in that region of the needle support means which is associated with the heads of the needles. This leaves enough space in the remaining area of the needle support means for disposal of a pattern device.

The following description of a preferred embodiment of the invention serves to explain the invention in more detail in conjunction with the attached drawings, in which.

Figure 5:
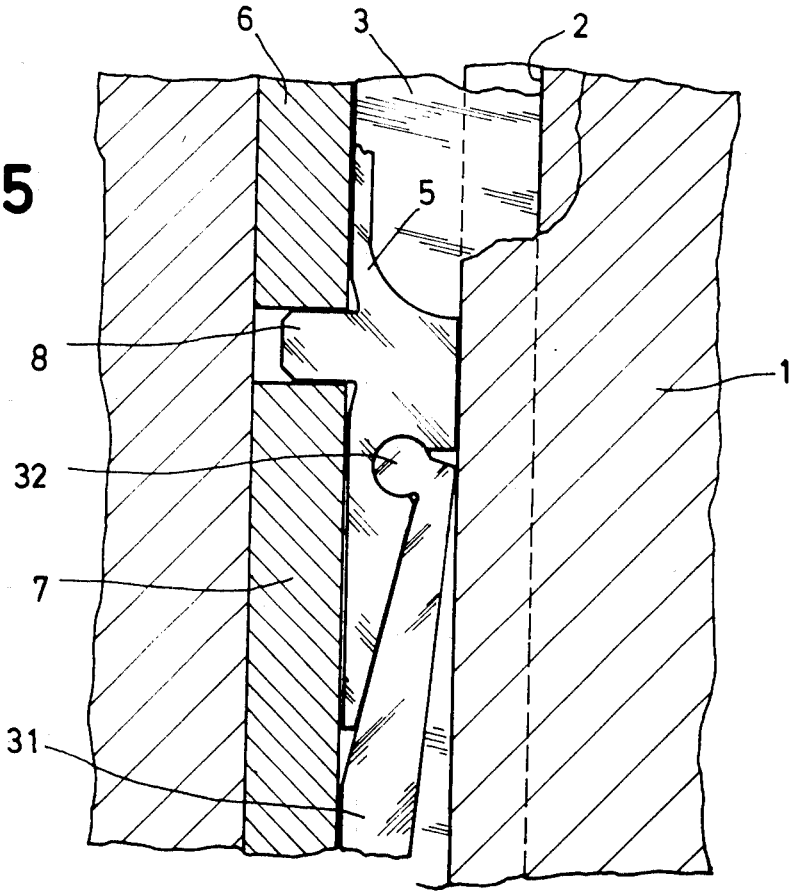

FIG. 5 schematically shows the arrangement of a pattern device in a region of the needle cylinder and needle cam located beneath the sinker.

Figure 1:
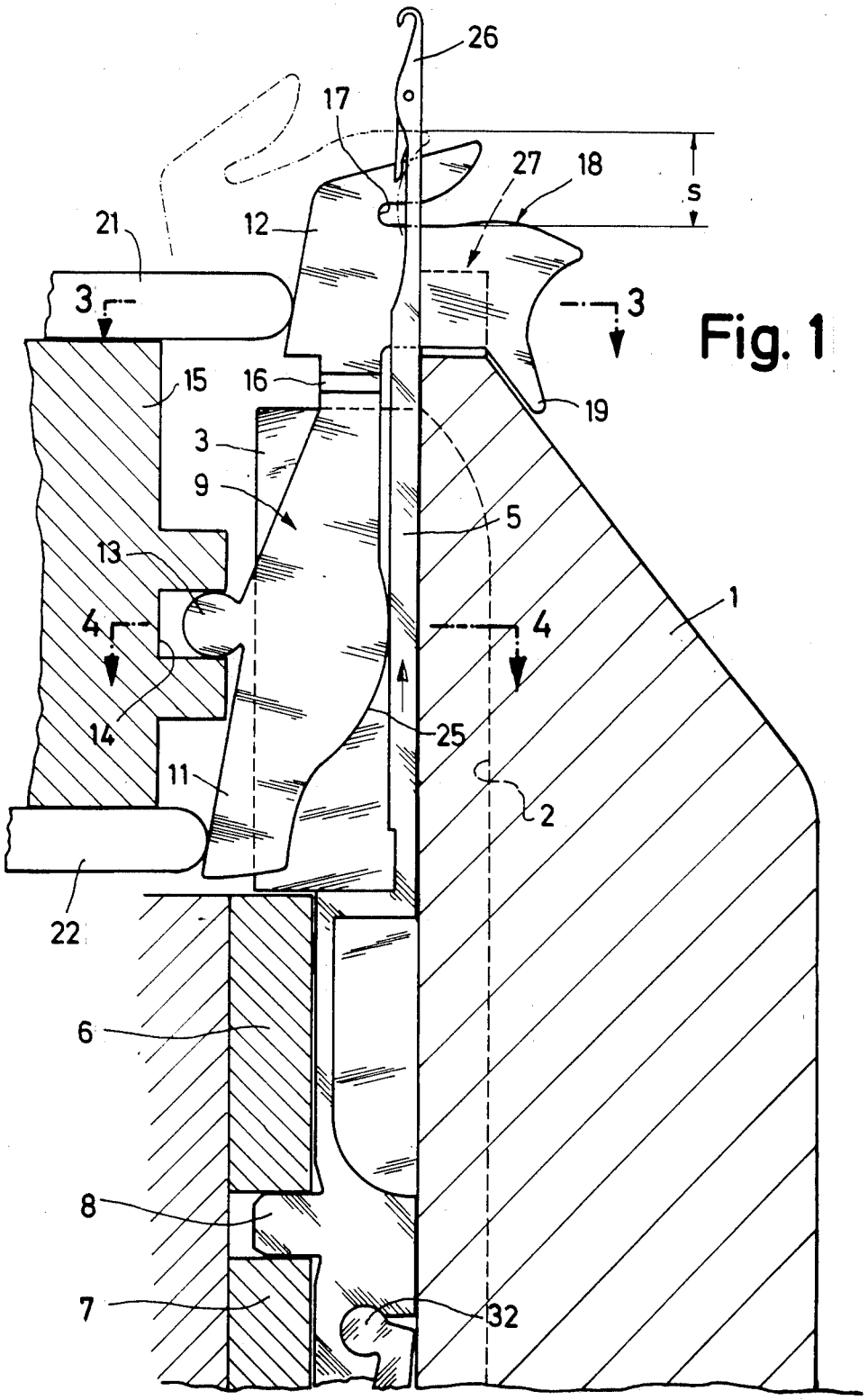
FIG. 1 is an axial, part-sectional view of a circular knitting machine having a sinker mounted in a cam guideway for pivoting movement.

FIG. 1 is an axial view of a needle cylinder 1 of a circular knitting machine of customary construction, this needle cylinder serving as needle support means. The axis of this cylinder 1 is in fact vertical. Radially extending, axis parallel grooves 2 are milled into the outer circumference of the needle cylinder 1—cf. FIGS. 4 and 5. Webs 3, which project radially outwards from the cylinder 1, are secured in the customary manner in the grooves 2 and slits 3 are thereby formed between the webs 3. The slits 4 accommodate, in the customary manner, knitting needles 5 which reciprocate in the longitudinal or axial direction of the cylinder 1 and their backs—cf. FIG. 4—rest against the outer circumference of the needle cylinder 1. The reciprocating movement of all the knitting needles 5 is controlled in the known manner by needle cam portions 6, 7 acting on butts 8 of the knitting needles 5.

Figure 3:
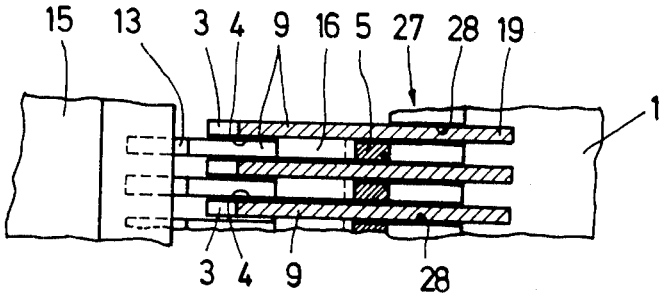
FIG. 3 is a cross-sectional view along line 3—3 in FIG. 1.
Figure 4:
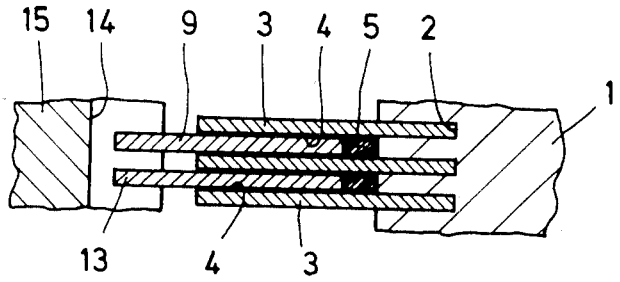
FIG. 4 is a cross-sectional view along line 4—4 in FIG. 1.

The slits 4 between the webs 3 accommodate not only the needles 5 but also pivoting sinkers 9—cf. FIG. 4. The sinkers 9 consist of a shaft portion 11 and a head portion 12. A swivel butt 13 projects from the shaft 11 and into a plane, horizontally extending guide groove 14 in a sinker cam 15. The sinker cam 15 is arranged above the needle cam formed by cam portions 6, 7. When the needle cylinder 1 rotates about its axis and relative to the stationary sinker cam, the swivel butt 13 slides along the guide groove 14 without the sinker 9 thereby making any movement at all in relation to the needle 5 since the guide groove 14 is plane and extends horizontally. The sinker 9 is bent to the shape of a crank such that its head portion 12 is offset relative to its shaft portion 11 and it therefore extends, with reference to FIG. 1, behind the needle 5 illustrated in this Figure and between this needle and the next needle 5 located further to the rear—cf. FIG. 3. Reference numeral 16 in FIGS. 1 and 3 designates the place where the sinker 9 is bent to the shape of a crank. The head portion 12 has a throat 17 and a knitting surface 18. The sinker head portion 12 also comprises a guide nose 19, the purpose of which will be explained.

Figure 2:
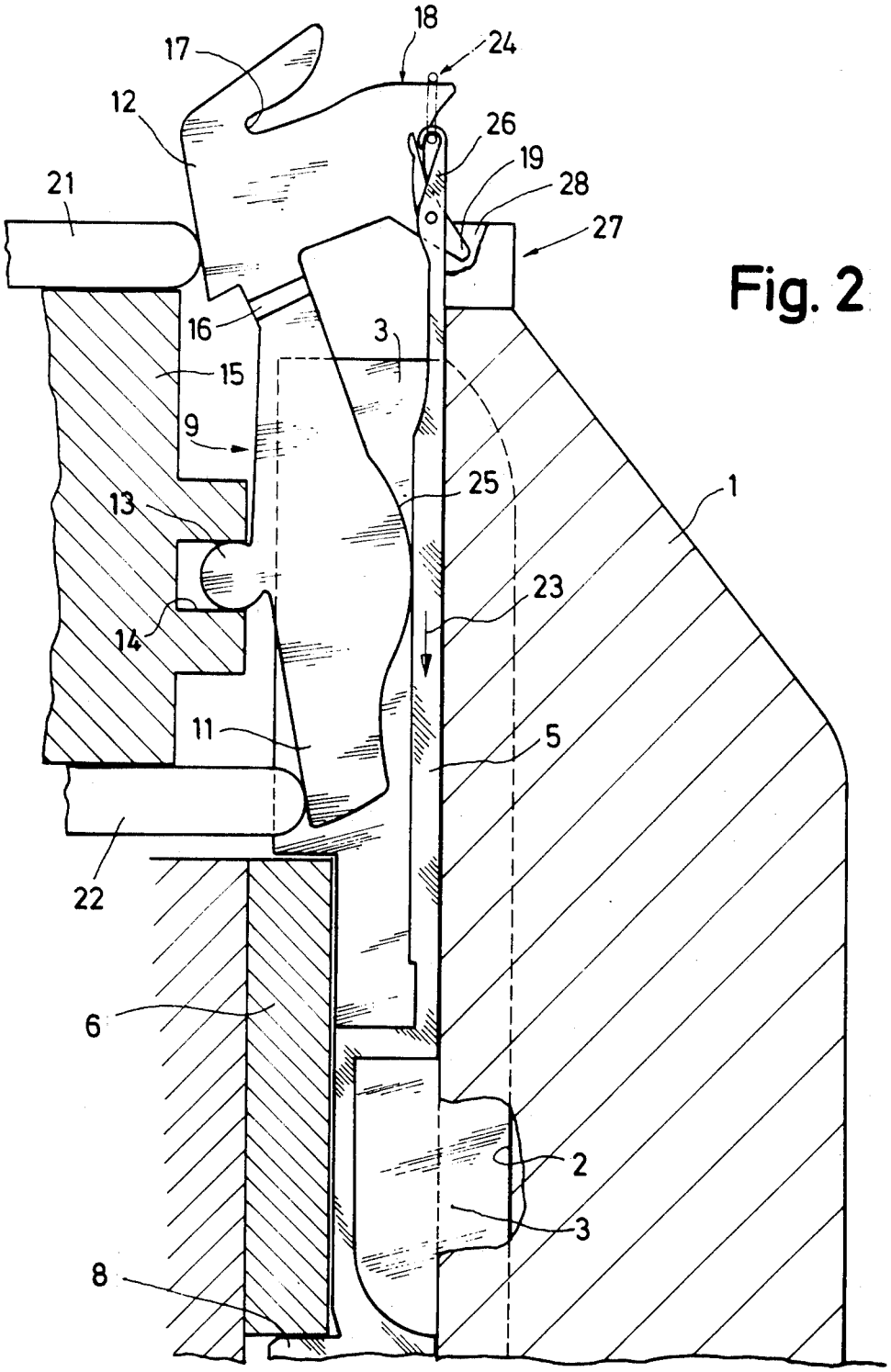
FIG. 2 is a view similar to FIG. 1 showing the sinker in a different position.

The sinker 9 is pivotable about its circular swivel butt 13 between two positions which are illustrated in FIGS. 1 and 2 by solid lines. The position shown in FIG. 2 is also indicated in FIG. 1 by dash-dot lines. FIG. 1 shows that when the sinker 9 is pivoted radially outwards the knitting surface is raised through a distance s with reference to a given point and hereby moves contrary to the inward draw movement of the needles 5. The distance from the sinker throat 17 and the knitting surface 18 to the adjacent top edge of the needle cylinder 1 is, of course, altered thereby.

The pivoting movement of the sinker 9 is controlled in the usual way by two cam portions 21 and 22 provided on the sinker cam 15.

It is to be noted that movement of the knitting surface 18 contrary to the draw movement of the needle—arrow 23 in FIG. 2—is brought about solely as a result of pivoting movement of the sinker 9 which cannot be displaced at all in the longitudinal direction. The reason for the large variation in the distance of the knitting surface 18 from the needle cylinder 1 is to be found in the geometrical arrangement of the swivel butt 13. The distance between the swivel butt 13 and the knitting surface 18 is, however, relatively short. If these geometrical conditions are varied further, the distance s could be even greater, without any displacement whatsoever of the sinker 9 in the longitudinal direction, i.e. parallel to movement of the needle 5. The loop or stitch knocked over at the knitting surface 18 is indicated in FIG. 2 by a dash-dot line and given the reference numeral 24.

As illustrated, the sinker cam portions 21, 22 engage on either the head portion 12 or on the shaft portion 11 of the sinker 9 on either side of the swivel butt 13 and thereby bring about the pivoting movement of the sinker. In the embodiment illustrated, one knitting needle 5 and sinker 9 are placed each time radially behind one another in a common slit 4 between the webs 3 secured to the needle cylinder 1. So that the sinker head portion 12 can, as required for operation of the sinker, enter between two knitting needles 15 this head portion 12 is, as mentioned, offset relative to the shaft portion 11. The sinker shaft 11 has a "bulge" or curved portion 25 on its side facing the needle 5 which rests slidingly against this curved portion when moving up and down. Contact between needle shaft and sinker 9 is over a very narrow, line-like area and very little friction is caused. The head portion 12 of the sinker 9 is so narrow that it can freely enter between the heads 26 of the needles without touching the needles 5 with its sides.

In a further embodiment of the invention, which is not illustrated, the knitting needles 5 and sinkers 9 are arranged side by side in pairs in common slits 4 between the webs 3. In this case, it is not absolutely necessary for the head portion 12 to be offset relative to the shaft portion 11.

As further shown in the drawings, the relatively long knitting surface 18 of the sinker 9 is curved in such a way that it substantially remains constantly at right angles to the two adjacent knitting needles 5 during pivoting movement of the sinker. This is clearly seen in a comparison of the positions of sinker 9 as illustrated in FIGS. 1 and 2.

The upper side of needle cylinder 1 has an edge portion 27 which extends right around the cylinder and has radially extending, continuous slits 28 formed in it. These slits are of such a width that the parts of the sinker head portions 12 projecting radially inwards, in particular the guide noses 19, may penetrate freely into these slits without normally touching their sides. In this way, the head portion 12 is guided laterally and constantly, and thereby stabilized, during pivoting movement of the sinker 9.

Since the sinker 9, which is mounted for pivoting movement but is not displaceable in the longitudinal direction, is relatively short, enough space is available beneath this sinker, at the outer circumference of the needle cylinder 1, to accommodate a pattern device. This is indicated in FIG. 5, in which the upper portion of the needle cylinder 1 with the sinker 9 is omitted. The head 32 of a customary swivel pusher means 31 engages articulatedly in the lower end of needle 5. The pusher means 31 is disposed in the same slit as needle 5 between two webs 3. The swivel pusher means 31 has a butt (not illustrated), with which it engages in a cam guideway (also not illustrated) between corresponding cam portions. This butt would be located a considerable way below the edge of the drawing in FIG. 5. It serves to drive the needle upwardly or outwardly whereas the needle is drawn in (arrow 23) by the needle butt 8. The lower end of the swivel pusher means 31 which faces away from the needle 5 engages in the customary manner in a design sinker which is controllable by a selector device such that the butt of the swivel pusher means 31 can be tilted out of the cam guideway by means of the design sinker, namely due to the articulated connection between needle 5 and head 32 of the pusher means 31. This tilting movement is to the right as seen in FIG. 5. In this way, the swivel pusher means is disengaged from the cams controlling it and no longer moves in the longitudinal direction. Consequently, it no longer drives the needle 5, which is articulatedly connected to it, upwards or outwards and so the needle no longer reciprocates. By alternatingly selecting certain needles, patterns may be produced in the known way. A pattern device of this type is in no way obstructed by the sinker 9 located far above it.

The invention has been described above on the basis of a circular knitting machine. It may, however, be used in the same way on all suitable, stitch-forming machines, with which spring beard or latch needles are displaced in a longitudinal direction more or less exactly and individually or together. The sinker cam 15 with the cam portions 21, 22 may be removed as a unit for the purpose of changing the sinker. This also facilitates the changing of the knitting needles 5.

In the embodiment described in the aforesaid and illustrated in the drawings, the cam guideway 14 receiving the swivel butt 13 of the sinker 9 extends in a (horizontal) plane. In a further embodiment of the invention, this guideway may be inclined, in sections, either upwardly or downwardly relative to this plane so that the sinker 9 may be moved up and down independently of and in addition to its pivoting movement.

I claim:

1. A stitch-forming machine comprising needles (5) having needle shafts and needle heads (26), needle support means (1) for guiding said needles for longitudinal inward and outward displacement, needle cams (6,7) for controlling said needles, sinkers having sinker throats (17) and knitting surfaces (18), sinker support means (15) separate from said needle support means for guiding said sinkers, sinker cams (21, 22) for controlling said sinkers, said sinkers having shaft portions and head portions and protruding swivel butts, said sinker support means having a plane cam guideway (14) for receiving said protruding swivel butts to mount said sinkers for pivotal movement while restraining said sinkers against movement in the longitudinal direction, the geometrical relation of the swivel butts (13) on the sinkers with relation to the knitting surfaces (18) being such that by pivoting the sinkers the knitting surfaces thereof are raised through a predetermined distance with reference to a given point on the edge of the needle support means (1) in the region of the knitting heads to move the knitting surfaces (18) in a direction opposite to the inward displacement of the needles, said needle support means having slits (4), one sinker (9) being arranged behind one needle (5) in each of said slits as viewed from said needle support means in the direction of said sinker support means, said sinkers (9) having crank-like bendings (16) between their shafts (11) and heads (12) to allow the sinker heads (12) to penetrate between two adjacent needle heads (26), said sinker shafts (11) having curved portions (25) on their edges opposite to the swivel butts (13), said curved portions facing said needle shafts and resting slideably thereon only in a narrow line-like area.

2. A machine as defined in claim 1 in which said needle support means has guide slits, said sinkers having guide noses disposed in said guide slits in all positions of said sinker.

* * * * *